US006425732B1

(12) United States Patent
Rouse et al.

(10) Patent No.: US 6,425,732 B1
(45) Date of Patent: Jul. 30, 2002

(54) SHROUDED ROTARY COMPRESSOR

(75) Inventors: Gregory C. Rouse, Westlake Village; Mike Swinton, Fallbrook; Dadjar Modjahedpour, Glendale, all of CA (US)

(73) Assignee: Capstone Turbine Corporation, Chatsworth, CA (US)

( * ) Notice: Subject to any disclaimer, the term of this patent is extended or adjusted under 35 U.S.C. 154(b) by 0 days.

(21) Appl. No.: 09/643,625

(22) Filed: Aug. 22, 2000

(51) Int. Cl.[7] ..... F01D 1/12

(52) U.S. Cl. ..... 415/55.1; 29/889.21; 29/447; 29/407.05

(58) Field of Search ..... 415/55.1, 55.2, 415/55.3, 173.6, 228; 416/189; 29/889.21, 447, 407.05

(56) References Cited

U.S. PATENT DOCUMENTS 5,702,229 A * 12/1997 Moss et al. ..... 415/55.4

* cited by examiner

*Primary Examiner*—Edward K. Look
*Assistant Examiner*—James M McAleenan
(74) *Attorney, Agent, or Firm*—Irell & Manella LLP

(57) ABSTRACT

A method of combining an impeller and a shroud includes selecting a rotatable impeller having impeller blades with radially extending distal ends defining a predetermined outer impeller diameter. A shroud element is then selected having an inner diameter less than the outer impeller diameter. The shroud element is then attached to at least some of the radially extending distal ends of the impeller blades by forming an interference fit between the inner shroud diameter and the outer impeller diameter.

13 Claims, 9 Drawing Sheets

FIG. 6
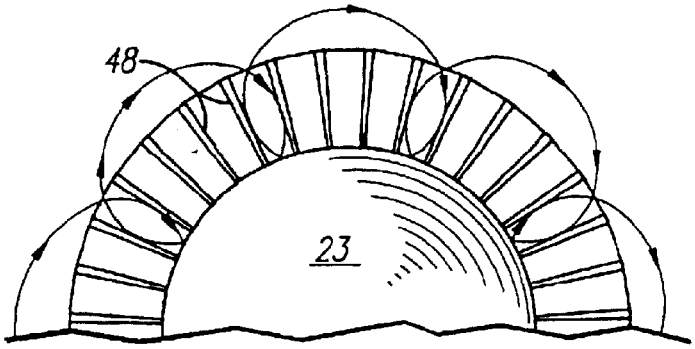
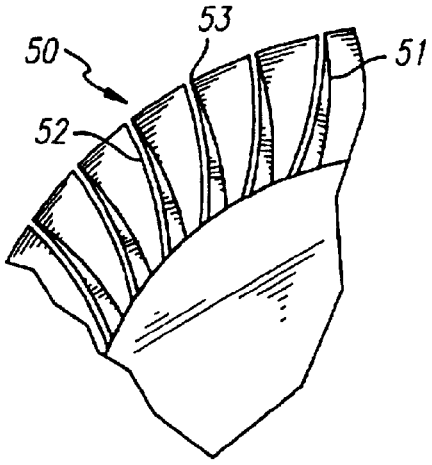
FIG. 7
FIG. 8
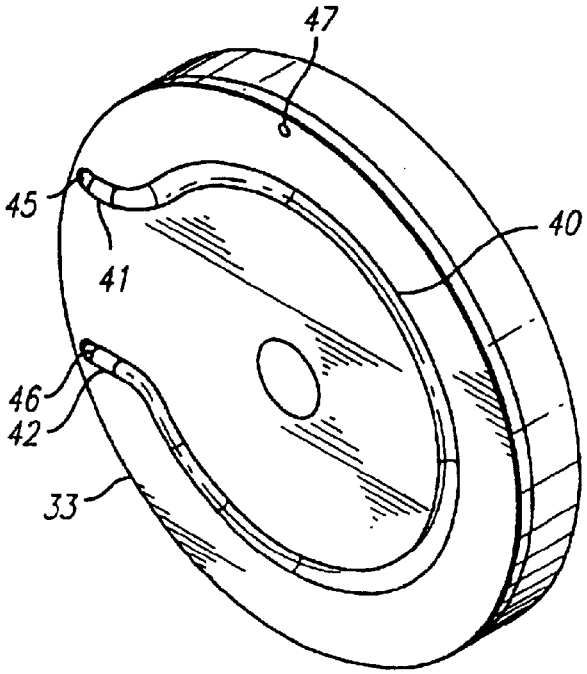

SHROUDED ROTARY COMPRESSOR

TECHNICAL FIELD

The present invention relates to a method of manufacturing an impeller element having a shroud attached to the impeller blades, and particularly to a compressor/turbine permanent magnet motor/generator having a shroud attached to the impeller blades by an interference fit therebetween.

BACKGROUND ART

A helical flow compressor is a high-speed rotary machine that accomplishes compression by imparting a velocity head to each fluid particle as it passes through the machine's impeller blades and then converting that velocity head into a pressure head in a stator channel that functions as a vaneless diffuser. While in this respect a helical flow compressor has some characteristics in common with a centrifugal compressor, the primary flow in a helical flow compressor is peripheral and asymmetrical, while in a centrifugal compressor, the primary flow is radial and symmetrical. The fluid particles passing through a helical flow compressor travel around the periphery of the helical flow compressor impeller within a generally horseshoe shaped stator channel. Within this channel, the fluid particles travel along helical streamlines, the centerline of the helix coinciding with the center of the curved stator channel. This flow pattern causes each fluid particle to pass through the impeller blades or buckets many times while the fluid particles are traveling through the helical flow compressor, each time acquiring kinetic energy. After each pass through the impeller blades, the fluid particles reenter the adjacent stator channel where they convert their kinetic energy into potential energy and a resulting peripheral pressure gradient in the stator channel.

The multiple passes through the impeller blades (regenerative flow pattern) allows a helical flow compressor to produce discharge heads of up to fifteen (15) times those produced by a centrifugal compressor operating at equal tip speeds. Since the cross-sectional area of the peripheral flow in a helical flow compressor is usually smaller than the cross-sectional area of the radial flow in a centrifugal compressor, a helical flow compressor would normally operate at flows which are lower than the flows of a centrifugal compressor having an equal impeller diameter and operating at an equal tip speed. These high-head, low-flow characteristics of a helical flow compressor make it well suited to a number of applications where a reciprocating compressor, a rotary displacement compressor, or a low specific-speed centrifugal compressor would not be as well suited.

A helical flow compressor can be utilized as a turbine by supplying it with a high pressure working fluid, dropping fluid pressure through the machine, and extracting the resulting shaft horsepower with a generator. Hence the term "compressor/turbine" which is used throughout this application.

Among the advantages of a helical flow compressor or a helical flow turbine are:

(a) simple, reliable design with only one rotating assembly;

(b) stable, surge-free operation over a wide range of operating conditions (i.e. from full flow to no flow);

(c) long life (e.g., 40,000 hours) limited mainly by their bearings;

(d) freedom from wear product and oil contamination since there are no rubbing or lubricated surfaces utilized;

(e) fewer stages required when compared to a centrifugal compressor; and (f) higher operating efficiencies when compared to a very low specific-speed (high head pressure, low impeller speed, low flow) centrifugal compressor.

On the other hand, a helical flow compressor or turbine cannot compete with a moderate to high specific-speed centrifugal compressor, in view of their relative efficiencies. While the best efficiency of a centrifugal compressor at a high specific-speed operating condition would be on the order of seventy-eight percent (78%), at a low specific-speed operating condition of a centrifugal compressor could have an efficiency of less than twenty percent (20%). A helical flow compressor operating at the same low specific-speed and at its best flow can have efficiencies of about fifty-five percent (55%) with curved blades and can have efficiencies of about thirty-eight percent (38%) with straight radial blades.

The flow in a helical flow compressor can be visualized as two fluid streams which first merge and then divide as they pass through the compressor. One fluid stream travels within the impeller buckets and endlessly circles the compressor. The second fluid stream enters the compressor radially through the inlet port and then moves into the horseshoe shaped stator channel which is adjacent to the impeller buckets. Here the fluids in the two streams merge and mix. The stator channel and impeller bucket streams continue to exchange fluid while the stator channel fluid stream is drawn around the compressor by the impeller motion. When the stator channel fluid stream has traveled around most of the compressor periphery, its further circular travel is blocked by the stripper plate. The stator channel fluid stream then turns radially outward and exits from the compressor through the discharge port. The remaining impeller bucket fluid stream passes through the stripper plate within the buckets and merges with the fluid just entering the compressor/turbine.

The fluid in the impeller buckets of a helical flow compressor travels around the compressor at a peripheral velocity which is essentially equal to the impeller blade velocity. It thus experiences a strong centrifugal force which tends to drive it radially outward, out of the buckets. The fluid in the adjacent stator channel travels at an average peripheral velocity of between five (5) and ninety-nine (99) percent of the impeller blade velocity depending upon the compressor discharge flow. It thus experiences a centrifugal force which is much less than that experienced by the fluid in the impeller buckets. Since these two centrifugal forces oppose each other and are unequal, the fluid occupying the impeller buckets and the stator channel is driven into a circulating or regenerative flow. The fluid in the impeller buckets is driven radially outward and "upward" into the stator channel. The fluid in the stator channel is displaced and forced radially inward and "downward" into the impeller bucket.

The fluid in the impeller buckets of a helical flow turbine travels around the turbine at a peripheral velocity which is essentially equal to the impeller blade velocity. It thus experiences a strong centrifugal force which would like to drive it radially outward if unopposed by other forces. The fluid in the adjacent stator channel travels at an average peripheral velocity of between one hundred and one percent (101%) and two hundred percent (200%) of the impeller blade velocity, depending upon the compressor discharge flow. It thus experiences a centrifugal force which is much greater than that experienced by the fluid in the impeller buckets. Since these two centrifugal forces oppose each other and are unequal, the fluid occupying the impeller buckets and the stator channel is driven into a circulating or regenerative flow. The fluid in the impeller buckets is driven radially inward and "upward" into the stator channel. The fluid in the stator channel is displaced and forced radially outward and "downward" into the impeller bucket.

While the fluid is traveling regeneratively, it is also traveling peripherally around the stator-impeller channel. Thus, each fluid particle passing through a helical flow compressor or turbine travels along a helical streamline, the centerline of the helix coinciding with the center of the generally horseshoe shaped stator-impeller channel.

While the unique capabilities of a helical flow compressor would seem to offer many applications, the low flow limitation has severely curtailed their widespread utilization.

Permanent magnet motors and generators, on the other hand, are used widely in many varied applications. This type of motor/generator, such as in U.S. Pat. No. 5,899,673, has a stationary field coil and a rotatable armature of permanent magnets. In recent years, high energy product permanent magnets having significant energy increases have become available. Samarium cobalt permanent magnets having an energy product of twenty-seven (27) megagauss-oersted (mgo) are now readily available and neodymium-iron-boron magnets with an energy product of thirty-five (35) megagauss-oersted are also available. Even further increases of mgo to over 45 megagauss-oersted promise to be available soon. The use of such high energy product permanent magnets permits increasingly smaller machines capable of supplying increasingly higher power outputs. The permanent magnet rotor may comprise a plurality of equally spaced magnetic poles of alternating polarity or may even be a sintered one-piece magnet with radial orientation. The stator would normally include a plurality of windings and magnet poles of alternating polarity. In a generator mode, rotation of the rotor causes the permanent magnets to pass by the stator poles and coils and thereby induces an electric current to flow in each of the coils. In the motor mode, electrical current is passed through the coils which will cause the permanent magnet rotor to rotate.

In various rotating impeller designs, shrouds have been added to improve aerodynamic performance of the blades. For example, shrouds have been attached to the impeller blades by casting large impeller blades which are thick enough to locally receive a screw to attach the shroud. This type of attachment requires a relief hole through which the screw is inserted. The relief hole requires close tolerances, which can be burdensome and costly to the manufacturing process. This method generally only works for large impellers and is not desirable for a small thin impeller, as implemented in a permanent magnet motor/generator or a small gas turbine engine.

Accordingly, it is desirable to provide a method of attaching a shroud to a small impeller in a manner in which manufacturing costs are minimized and part quality and strength are enhanced.

SUMMARY OF THE INVENTION

The present invention overcomes the above-referenced shortcomings of prior art shroud/impeller assemblies by providing a shroud which is attached to an impeller by an interference fit.

Specifically, the present invention improves upon the compressor/turbine permanent magnet motor/generator of U.S. Pat. No. 5,899,673, and the efficiency of the '673 invention by controlling fluid flow with a shroud attached to the impeller. To accomplish such an improvement, this invention incorporates: a housing including first and second stators positioned within the housing and having respective channels cooperating to define a substantially annular pathway within the housing; a shaft rotatably supported within the housing; a rotatable element mounted for rotation with the shaft and having impeller blades substantially within the pathway, the impeller blades having respective radially extending distal ends defining an outer impeller diameter; and a shroud surrounding the rotatable element and connected thereto by an interference fit with at least some of the distal ends, the shroud in transverse cross-section having one configuration at the interference fit and another configuration outwardly thereof, whereby the other configuration cooperates with the channels of the first and second stators to define a helical pathway around the shroud.

Therefore, it is an object of the present invention is to attach the shroud to the impeller with an interference fit. This may be accomplished by either heating and cooling the shroud to be placed in juxtaposition to the impeller blades, or, alternatively, by forcing the shroud over the impeller blades.

Additionally, it is an object that the shroud in transverse cross-section may comprise a rounded portion which engages flowing fluid to encourage smooth fluid flow and discourage separation of the fluid from the shroud.

The above objects and other objects, features, and advantages of the present invention are readily apparent from the following detailed description of the best mode for carrying out the invention when taken in connection with the accompanying drawings.

BRIEF DESCRIPTION OF DRAWINGS

Figure 1:
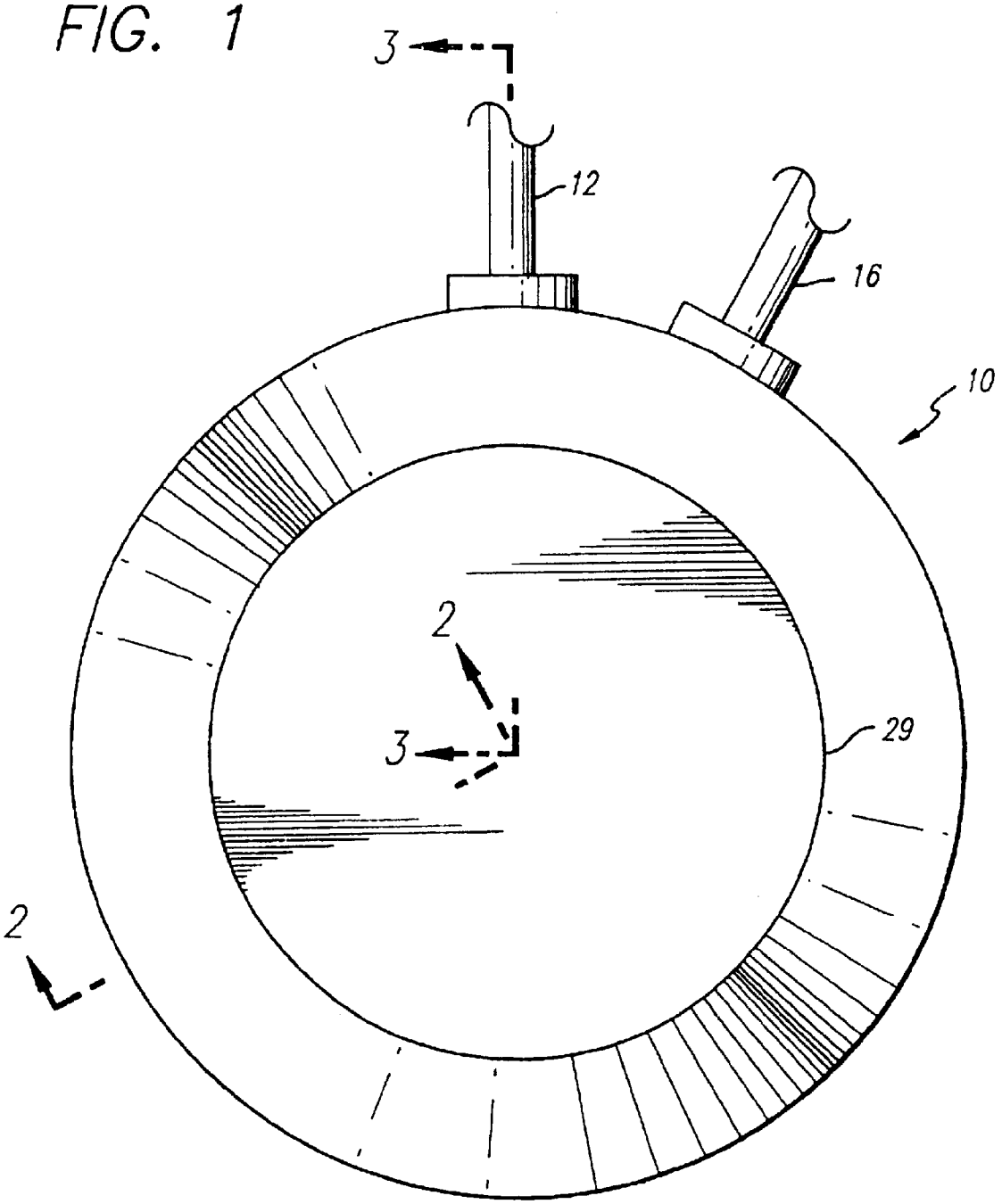
Figure 2:
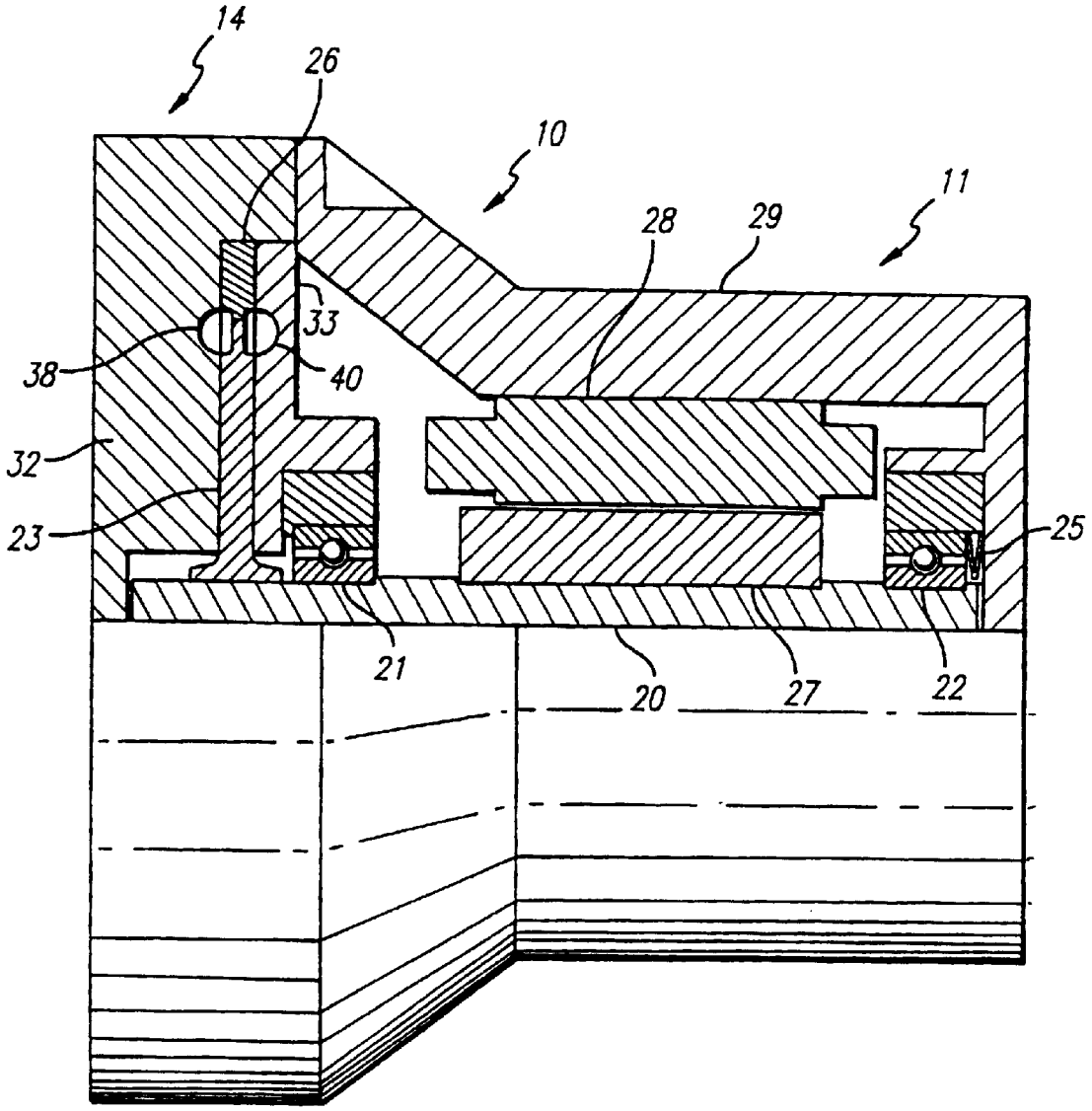
Figure 3:
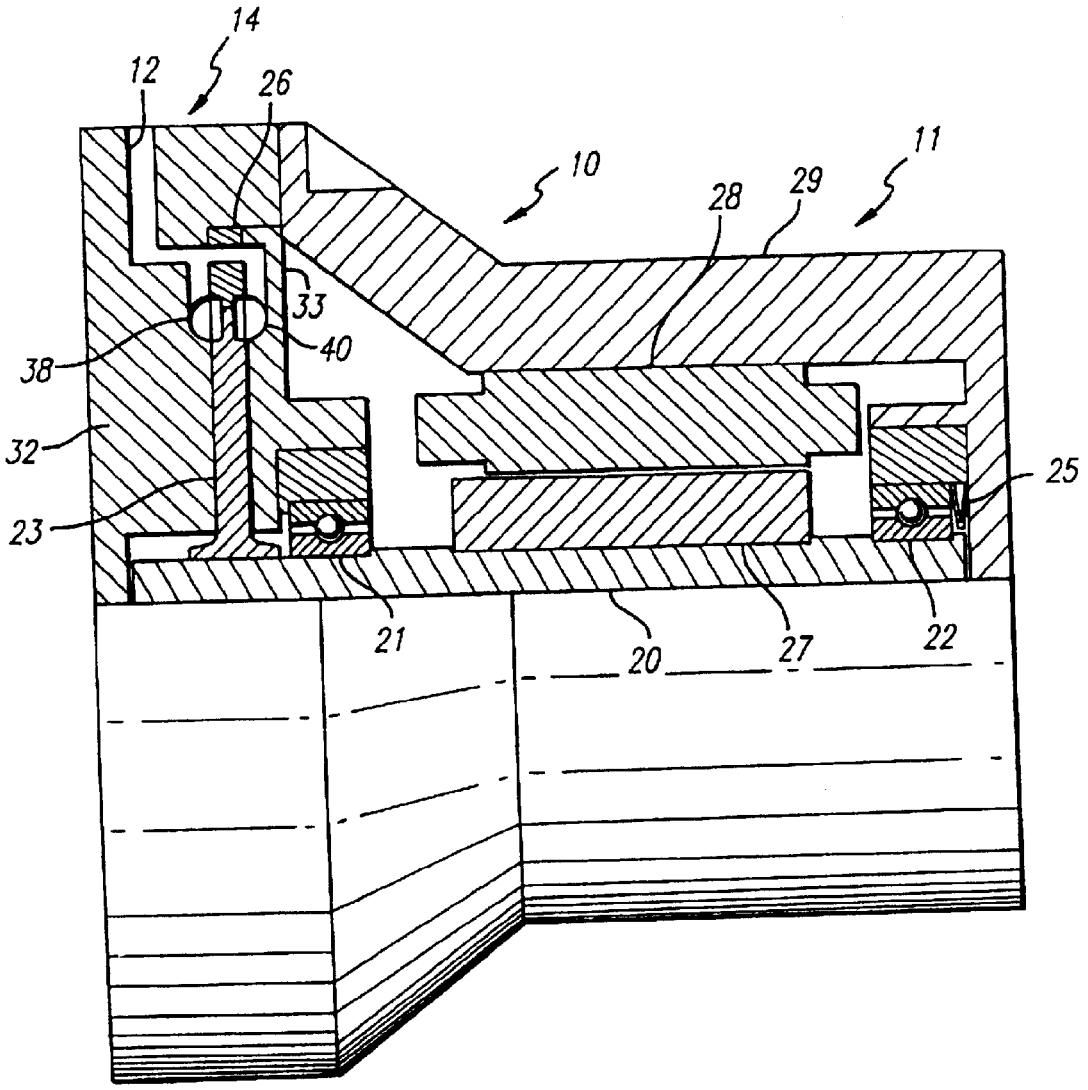
Figure 4:
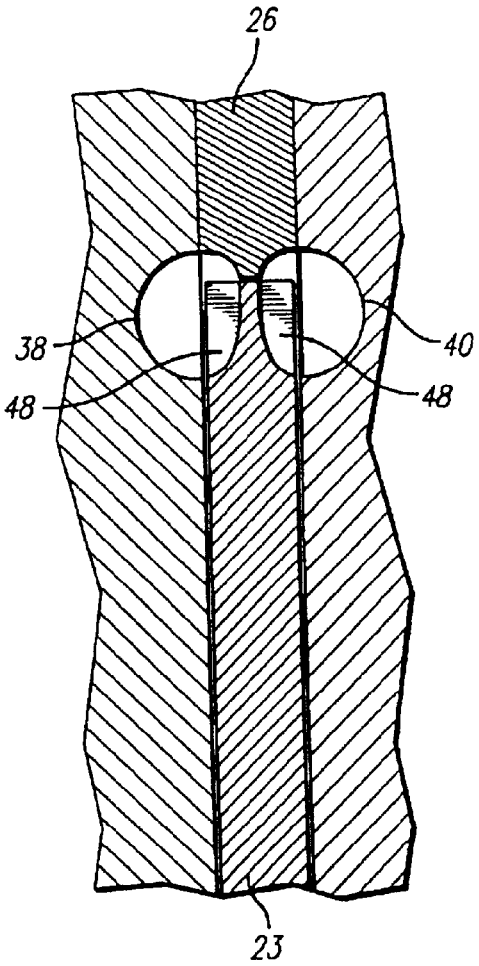
Figure 5:
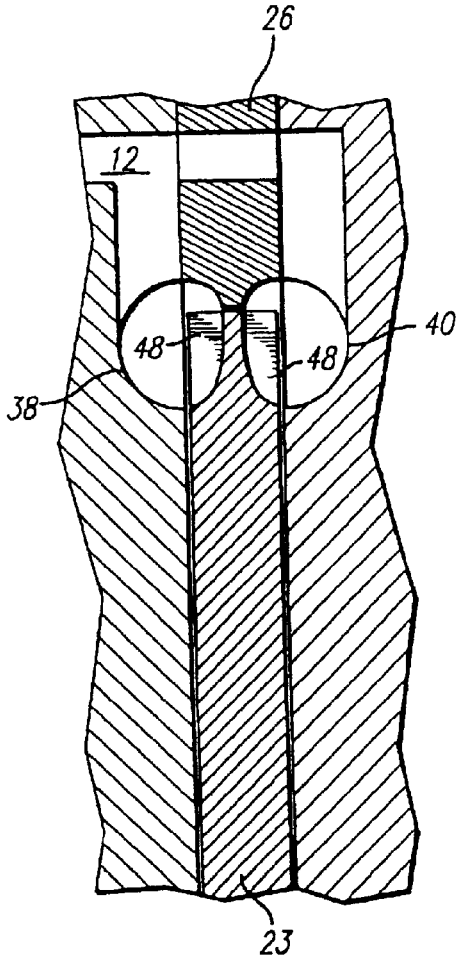
Figure 9:
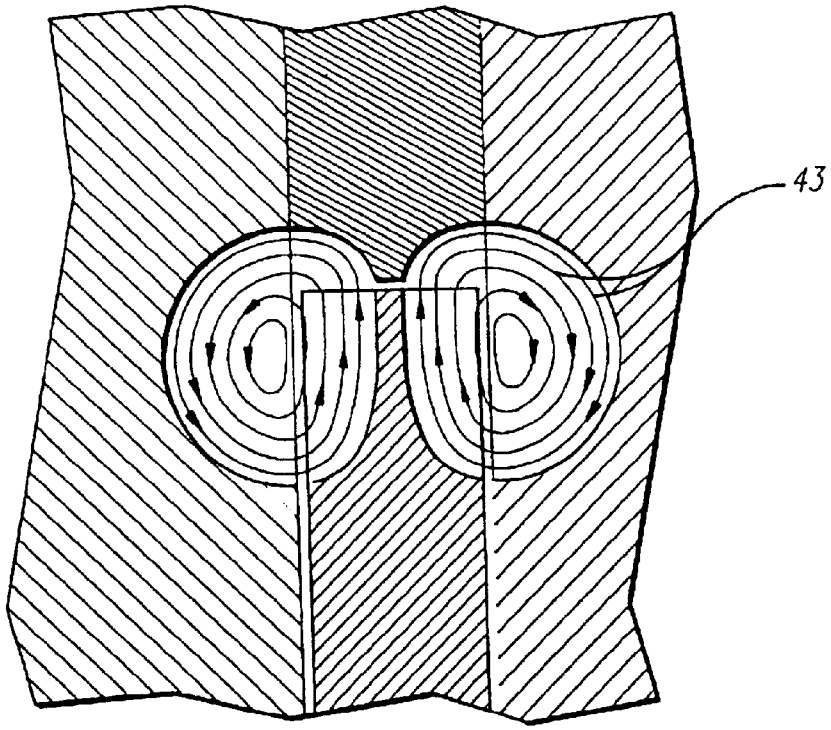
Figure 10:
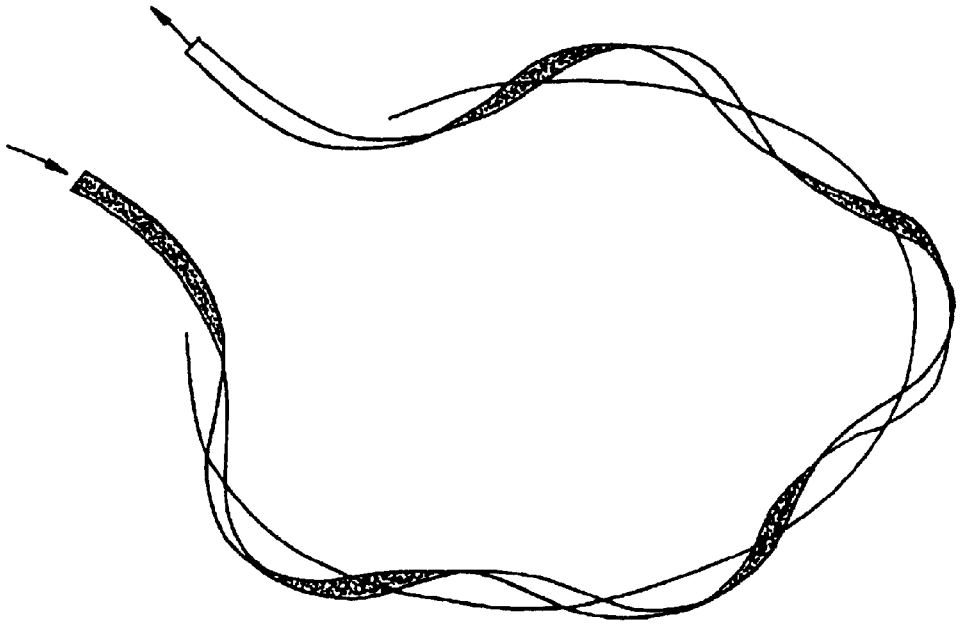
Figure 11:
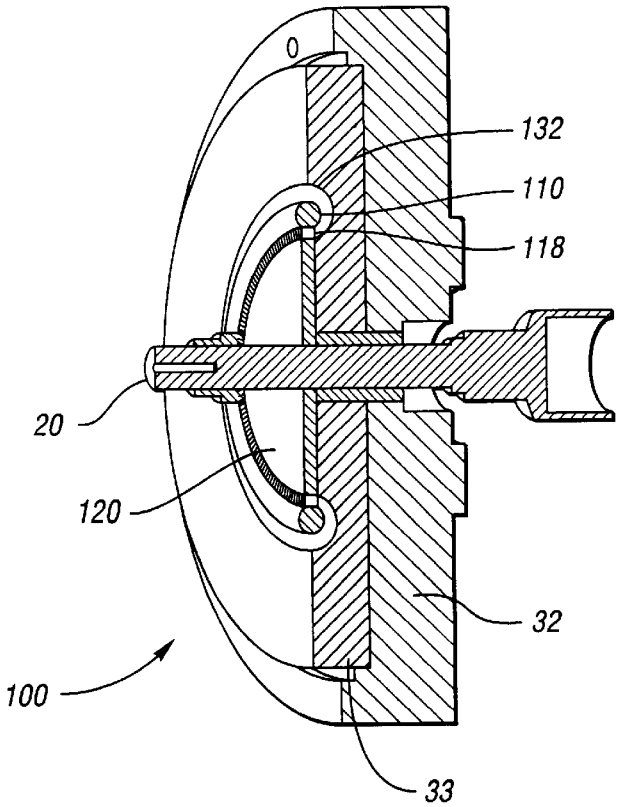
Figure 12:
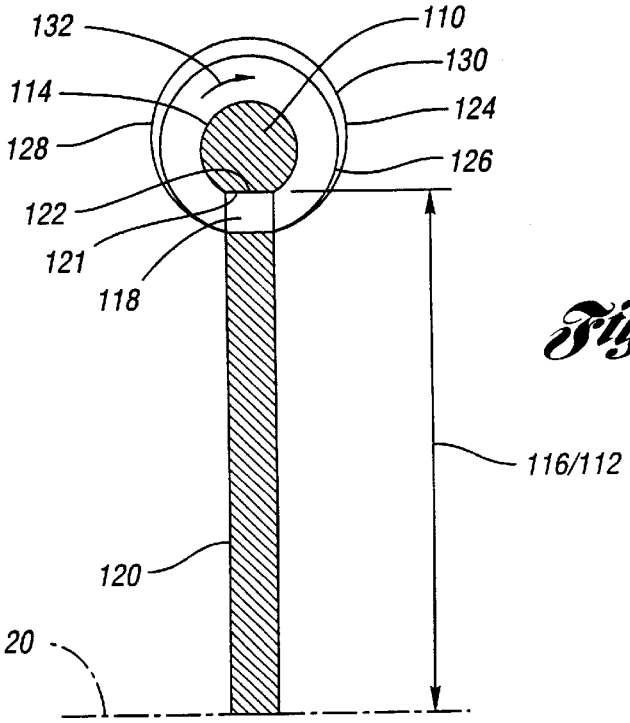
Figure 13:
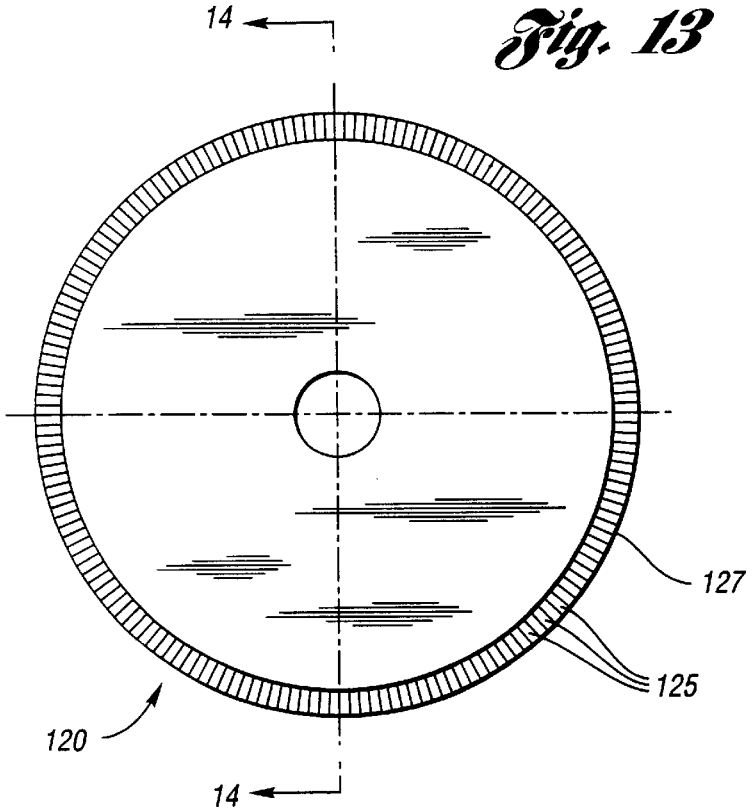
Figure 14:
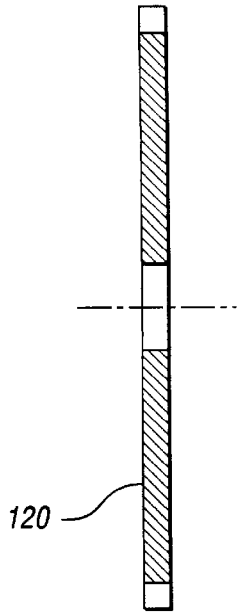
Figure 15:
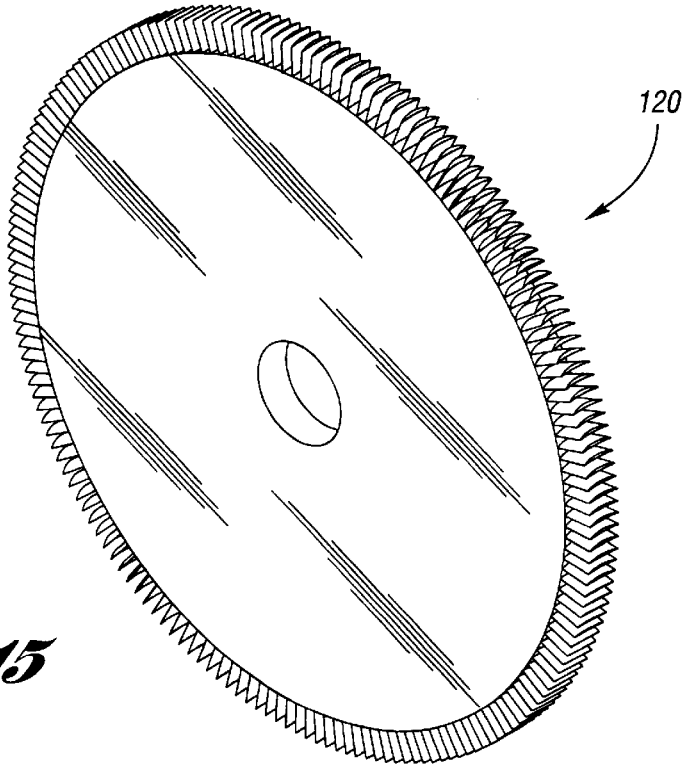
Figure 16:
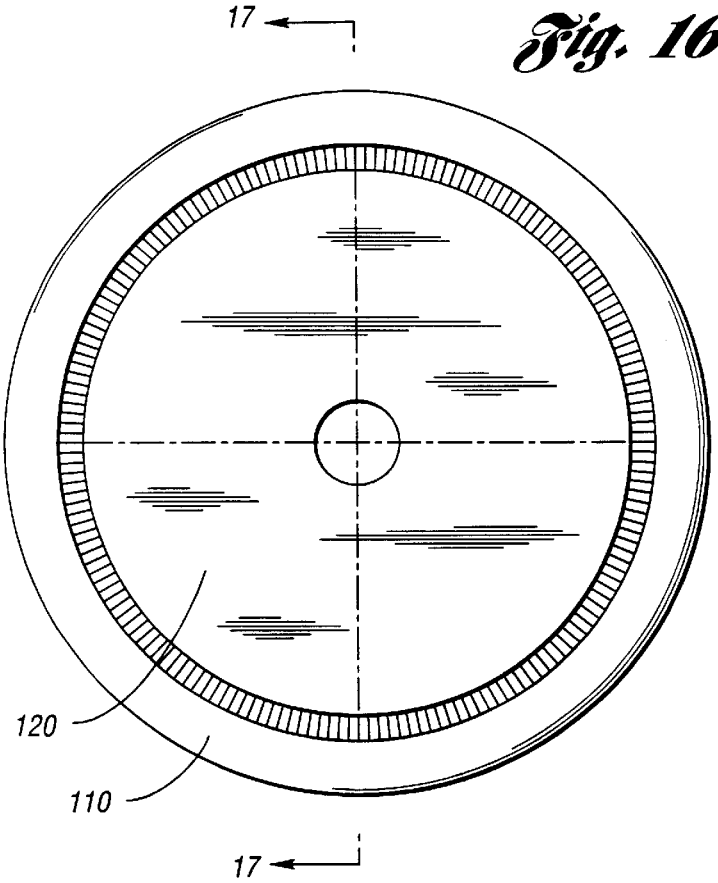
Figure 17:
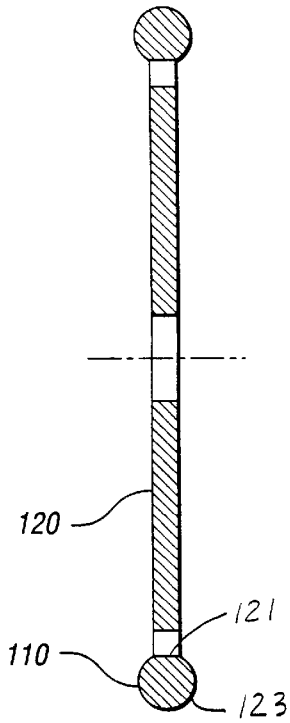
Figure 18:
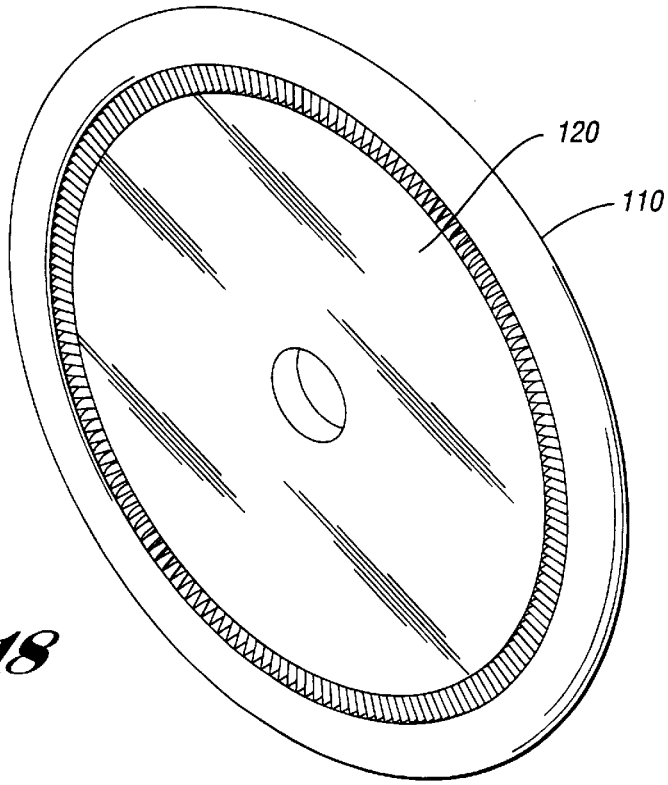

Having thus described the present invention in general terms, reference will now be made to the accompanying drawings in which:

FIG. 1 is an end view of a single stage helical flow compressor/turbine permanent magnet motor/generator in which the impeller/shroud of the present invention may be implemented;

FIG. 2 is a cross sectional view of the helical flow compressor/turbine permanent magnet motor/generator of FIG. 1 taken along line 2—2;

FIG. 3 is a cross sectional view of the helical flow compressor/turbine permanent magnet motor/generator of FIG. 1 taken along line 3—3;

FIG. 4 is an enlarged sectional view of a portion of the helical flow compressor/turbine permanent magnet motor/generator of FIG. 2;

FIG. 5 is an enlarged sectional view of a portion of the helical flow compressor/turbine permanent magnet motor/generator of FIG. 3;

FIG. 6 is an enlarged partial plan view of the helical flow compressor/turbine impeller having straight radial blades and illustrating the flow of fluid therethrough;

FIG. 7 is an enlarged partial plan view of a helical flow compressor/turbine impeller having curved blades;

FIG. 8 is a perspective view of a stator channel plate of the helical flow compressor/turbine permanent magnet motor/generator of FIGS. 1–5;

FIG. 9 is an enlarged sectional view of a portion of FIG. 5 illustrating fluid flow streamlines in the impeller blades and fluid flow stator channels;

FIG. 10 is a schematic representation of the flow of fluid through a helical flow compressor/turbine;

FIG. 11 shows a cut-away perspective view of a radial flow compressor in accordance with the present invention;

FIG. 12 shows a schematically arranged sectional view of a shroud and impeller in a radial flow compressor, such as that shown in FIG. 11;

FIG. 13 shows a plan view of an impeller in accordance with the present invention;

FIG. 14 shows a sectional view taken at line 14—14 of FIG. 13;

FIG. 15 shows perspective view of the impeller of FIG. 13;

FIG. 16 shows a plan view of an impeller and shroud in accordance with the present invention;

FIG. 17 shows a sectional view taken at line 17—17 of FIG. 16; and FIG. 18 shows a perspective view of the impeller and shroud of FIG. 16.

BEST MODE FOR CARRYING OUT THE INVENTION

A single stage helical flow compressor/turbine permanent magnet motor/generator 10 is illustrated in FIGS. 1–3, as described in U.S. Pat. No. 5,899,673, and is a preferred environment in which an impeller in accordance with the present invention may be implemented. The permanent magnet motor/generator 10 includes a fluid inlet 12 to provide fluid to the helical flow compressor/turbine 14 of the helical flow compressor/turbine permanent magnet motor/generator 10 and a fluid outlet 16 to remove fluid from the helical flow compressor/turbine 14 of the helical flow compressor/turbine permanent motor/generator 10. The helical flow machine is referred to as a compressor/turbine since it can function both as a compressor and as a turbine. The permanent magnet machine is referred to as a motor/generator since it can function equally well as a motor to produce shaft horsepower or as a generator to produce electrical power.

The helical flow compressor/turbine permanent magnet motor/generator 10 includes a shaft 20 rotatably supported by bearings 21 and 22. The position of bearing 22 is maintained by two back-to-back Belleville type washers 25 which also prevent rotation of the outer bearing race. An impeller 23 is mounted at one end of the shaft 20, while permanent magnet rotor 27 is mounted at the opposite end thereof between bearings 21 and 22.

A stripper plate 26 is disposed radially outward from impeller 23. The permanent magnet rotor 27 on the shaft 2 disposed to rotate within stator 28 having electrical conductors which is disposed in the permanent magnet housing 29.

The impeller 23 is disposed to rotate between stator channel plate 32 and stator channel plate 33. The stripper plate 26 has a thickness slightly greater than the thickness of impeller 23 to provide a running clearance for the impeller 23 between stator channel plates 32 and 33. Stator channel plate 32 includes a generally horseshoe shaped fluid flow stator channel 38 having an inlet to receive fluid from the fluid inlet 12. Stator channel plate 33 also includes a generally horseshoe shaped fluid flow stator channel 40 which mirrors the generally horseshoe shaped fluid flow stator channel 38 in the stator channel plate 32.

Each of the stator channels 38 and 40 include an inlet 45 and an outlet 46 disposed radially outward from the channel. The inlets and outlets of generally horseshoe shaped fluid flow stator channel 38 and generally horseshoe shaped fluid flow stator channel 40 are aligned. The fluid inlet 12 extends through stator channel plate 32 and stripper plate 26 to the inlets 45 of both of stator channel plate generally horseshoe shaped fluid flow stator channel 38 and stator channel plate generally horseshoe shaped fluid flow stator channel 40. The fluid outlet 16 extends from the outlets 46 of both stator channel plate generally horseshoe shaped fluid flow stator channel 38 and stator channel plate generally horseshoe shaped fluid flow stator channel 40.

The fluid flow stator channels are best illustrated in FIG. 8 which is a perspective view of the stator channel plate 33. The generally horseshoe shaped stator channel 40 is shown along with inlet 45 and outlet 46. The inlet 45 and outlet 46 for a single stage helical flow compressor/turbine would normally be relatively displaced approximately thirty (30) degrees. An alignment or locator hole 47 is provided in each of the stator channel plates 32 and 33 and the stripper plate 26. The inlet 45 is connected to the generally horseshoe shaped stator channel 40 by a converging nozzle passage 41 that converts fluid pressure energy into fluid velocity energy. Likewise, the other end of the generally horseshoe shaped stator channel 40 is connected to the outlet 46 by a diverging diffuser passage 42 that converts fluid velocity energy into fluid pressure energy.

The depth and cross-sectional flow area of fluid flow stator channel 40 are tapered preferably so that the peripheral flow velocity need not vary as fluid pressure and density vary along the fluid flow stator channel. When compressing, the depth of the fluid flow stator channel 40 decreases from inlet to outlet as the pressure and density increases. Converging nozzle passage 41 and diverging diffuser passage 42 allow efficient conversion of fluid pressure energy into fluid velocity energy and vice versa.

In a helical flow compressor/turbine, fluid enters the inlet port 12, is accelerated as it passes through the converging nozzle passage 41, is split into two (2) flow paths by stripper plate 26, then enters the end of a generally horseshoe shaped fluid flow stator channel axially adjacent to the impeller blades 48. The fluid is then directed radially inward to the root of the impeller blades 48 by a pressure gradient, accelerated through and out of the blades 48 by centrifugal force, from where it re-enters the fluid flow stator channel. During this time the fluid has been traveling tangentially around the periphery of the helical flow compressor/turbine. As a result of this, a helical flow is established as best shown in FIGS. 6, 9, and 10.

The impeller blades or buckets are best illustrated in FIGS. 6 and 7. The radial outward edge of the impeller 23 includes a plurality of low pressure blades 48. While these blades 48 may be radially straight as shown in FIG. 6, there may be specific applications and/or operating conditions where curved blades may be more appropriate or required.

FIG. 7 illustrates a portion of a helical flow compressor/turbine impeller having a plurality of curved blades 50. The curved blade base or root 51 has less of a curve than the leading edge 52 thereof. The curved blade tip 53, at both the root 51 and leading edge 52 would be generally radial.

FIG. 9 shows the flow through the impeller blades and the fluid flow stator channels by means of streamlines 43. On the other hand FIG. 10 schematically illustrates the helical flow around the centerline of the impeller and fluid flow stator channel. The turning of the flow is illustrated by the alternating solid and open flow pattern lines in FIG. 10.

An impeller in accordance with the present invention may also be implemented in a two (2) stage or three (3) stage helical flow compressor/turbine permanent magnet motor/generator as described in U.S. Pat. No. 5,899,673, which is hereby incorporated by reference in its entirety.

Turning to FIGS. 11–18, the present invention is illustrated wherein a shroud is attached to an impeller by an interference fit, and incorporated within the previously described helical flow compressor/turbine magnet motor/generator, with modifications to the fluid flow stator channels 38,40 previously described.

Referring to FIGS. 11 and 12, a radial flow compressor 100 is shown in accordance with the present invention, and may be implemented into the helical flow compressor/turbine permanent magnet motor/generator 10 illustrated and described above with reference to FIGS. 1–10. This structure is in all other respects similar to the structure described above with reference to FIGS. 1–10, except that the impeller 120 is provided with a shroud 110, and the flow channel 132 is configured accordingly to receive the shroud 110, as described in greater detail below. In FIG. 11, like numerals are used to identify like components, as described previously with reference to FIGS. 1–10.

Referring to FIG. 12, a shroud 110 is shown in combination with a rotatable impeller element 120. The rotatable impeller 120 has impeller blades 118, and is attached to a shaft 20 of a helical flow compressor/turbine, such as that shown in FIG. 2. The shroud 110 is attached by an interference fit to the impeller blades 118, and surrounded by a first wall 128 of a first stator plate and a second wall 130 of a second stator plate. The first wall 128 and second wall 130 cooperate in conjunction with the shroud 110 to define a flow pathway 132 for a fluid.

FIG. 12 schematically illustrates both a stator channel inlet 124 and stator channel outlet 126. As illustrated, the channel defined by the first and second walls 128,130, and shroud 110, becomes narrower between the stator channel inlet 124 and the stator channel exit 126. By reducing the stator channel cross-sectional area between the stator channel inlet 124 and the stator channel exit 126, the desired pressure and flow conditions are maintained within the channel to compensate losses between the stator channel inlet 124 and stator channel exit 126. In other words, the stator channel inlet 124 has a cross-sectional area larger than the stator channel exit 126 to compensate for losses that occur as the fluid 136 flows through the pathway 132, and the impeller blades 118, whereby decreasing the cross-sectional area maintains a desired pressure between the stator channel inlet 124 and the stator channel exit 126.

The shroud 110 is shown having a circular cross-section as indicated at reference numeral 114 in FIG. 12. Of course, the shroud 110 could comprise a plurality of various peripheral configurations to effect the flow pathway 132. By having a circular shroud diameter 114, separation of the fluid 136 from the shroud 110 is limited. This separation causes "verticality", which results in turbulence and efficiency losses. Therefore, by providing a proper shroud periphery 114, pumping efficiency is improved. Alternative shapes for the periphery 114 of the shroud 110 may be provided within the scope of the present invention. Specifically, the shroud periphery 114 may be configured in relation to the shape of the first and second walls 128 and 130 for defining the pathway 132.

An interference fit is used for attaching the shroud 110 to the impeller blades 118. The interference fit secures the shroud 110 to the impeller blades 118 by the shroud 110 applying compression forces upon the impeller blades 118, wherein the impeller blades 118 oppose such compression forces by resisting such compression. To create the compression forces, the shroud 110 is selected having a shroud inner radius 112 at the flat portion 121 of the shroud 110 less than an impeller radius 116. The radii 112/116 are schematically shown as identical in FIG. 12 when, in fact, there is a pre-assembly difference therebetween causing the interference fit. The dimensional difference between the smaller shroud inner radius 112 and the larger impeller radius 116 is referred to as an amount of interference, wherein the amount of interference corresponds to a strength of interference between the shroud 110 and the impeller 120, whereby at a required strength, the interference fit prevents axial movement of the shroud 110 in relation to the impeller blades 118.

To determine the strength of interference required, a strength analysis is performed. The strength analysis includes a growth analysis to determine the growth of the impeller 120 and the shroud 110 during a predetermined theoretical range of operation for establishing the shroud inner radius 112 necessary to provide the amount of interference required irrespective of the growth of the impeller 120 and the shroud 110. The theoretical range of operation is based upon predetermined parameters that affect the strength of interference. These parameters include impeller radius 116, materials, temperature ranges, and speed of rotation.

During operation, depending on the speed of rotation and the type of material, the dimensions of the impeller 120 and the shroud 110 will vary. Of primary concern are the effects of the material growth due to ambient temperatures and temperatures produced by operation of the machine, which cause the expansion of the shroud 110 and the impeller 120. Of further concern are the varying rates at which the shroud 110 may grow in relation to the impeller 120. If the shroud inner radius 112 grows at a rate faster than the impeller radius 116, the level of interference must be sufficiently maintained to prevent axial movement of the shroud 110, or, alternatively, if the shroud inner radius 112 grows at a rate slower than the impeller radius 116, the level of interference must be sufficiently maintained to prevent breakage of the shroud 110 or the impeller blades 118 and additionally to prevent axial movement of the shroud 110 in relation to the impeller blades 118.

Therefore, the strength analysis determines the level of interference necessary to prevent axial movement of the shroud by analyzing the rate and quantity of material growth, such that the dimensional difference between the smaller shroud inner radius 112 and the larger impeller radius 116 are sufficiently in contrast that, irrespective of the growth of the impeller 120 and the shroud 110, the shroud 110 is prevented from axial movement and breakage. As one ordinary in the skill will recognize, such strength analysis may be performed using finite element analysis computer software, such as ANSYS, available from Swanson Engineering of Canonsberg, Pa. Based on the strength analysis, the inner shroud radius 112 is selected.

The shroud 110 may then be attached to the impeller 120 by either forcing the shroud 110 upon the impeller blades 118 or, alternatively, by heating the shroud 120 for expansion, and cooling the shroud for shrinkage and engagement with the impeller blades 118. Either method will produce the interference fit, however, if the dimensional difference between the shroud inner radius 112 and the impeller radius 116 is sufficiently large, forcing of the shroud 110 upon the impeller 120 may damage the impeller blades 118, may not be a viable option.

The forcing of the shroud 110 upon the impeller 120 is accomplished by placing the shroud 110 within a fixture, not shown, containing the impeller 120. The fixture centers the shroud 110 in relation to the impeller 120 and applies a minimal compression to force the shroud 110 over the impeller 120. Additionally, the shroud inner radius 112 may be chamfered to facilitate the ease of forcing the shroud 110 upon the impeller 120.

The heating and cooling the shroud 110 upon the impeller 120 is accomplished by first heating the shroud 110, and then allowing the shroud 110 to cool upon the impeller 120. Heating requires the shroud inner radius 112 to expand in dimension so that the shroud 110 may be easily placed upon the impeller blades 118. Heating an aluminum shroud 110 to 400° F. will sufficiently increase the shroud inner radius 112 to a dimension greater than the impeller radius 116 to facilitate placing the shroud 110 in juxtaposition to the impeller 120. The preferred temperature may vary based upon the strength analysis. While the shroud 110 is sufficiently heated, the shroud 110 is placed within the fixture, not shown, containing the impeller 120, wherein the fixture centers the shroud 110 in relation to the impeller 120 and the shroud 110 is allowed to cool. Upon cooling, the shroud 110 forms the interference fit to the impeller 120.

FIGS. 13–15 show a plan view, sectional view and perspective view, respectively of impeller 120 in accordance with the present invention. FIGS. 16–18 show a plan view, sectional view and perspective view, respectively, of the shroud 110 attached to the impeller 120 in accordance with the present invention. As shown in FIG. 17, the shroud 110 includes a flat portion 121 at the interference fit, and a round portion 123 outwardly thereof to enhance flow.

As shown in FIGS. 13 and 14, the impeller 120 has radially extending impeller blades 125, each having a distal end 127. The distal ends 127 cooperate to form an outer impeller diameter (corresponding with the impeller radius 116 shown in FIG. 12). The outer impeller diameter is less than the inner diameter of the shroud 110 (corresponding with the shroud inner radius 112 shown in FIG. 12), formed by the flat portion 121 of the shroud 110.

while embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method of combining an impeller and a shroud comprising:

selecting a rotatable impeller element having impeller blades with radially extending distal ends defining a predetermined outer impeller diameter;

selecting a shroud element having an inner diameter less than the outer impeller diameter; and attaching the shroud element to at least some of the radially extending distal ends of the impeller blades by forming an interference fit between the inner shroud diameter and the outer impeller diameter.

2. The method of claim 1, wherein said step of selecting a shroud element comprises:

predetermining a theoretical operating condition in which the impeller and shroud elements will operate;

performing strength analysis to determine the amount of interference fit required to effect the secure attachment of the shroud element to the ends of the impeller blades at the predetermined operating condition wherein the performance of the strength analysis includes, performing growth analysis to determine the growth of the impeller and shroud elements during theoretical operating condition, thereby to determine the shroud element thickness required to provide the required amount of interference fit irrespective of the growth of the impeller and shroud elements; and selecting the shroud element in accordance with such strength analysis.

3. The method of claim 2 further comprising selecting an outer shroud diameter configuration to discourage separation of the flow from the outer shroud diameter.

4. The method of claim 3, further comprising selecting a shroud having an at least partially circular cross-section to discourage separation caused by centrifugal forces of the fluid flow in the radial direction.

5. The method of claim 1, wherein said step of attaching the shroud comprises forcing the shroud over the impeller to produce the interference fit.

6. The method of claim 5, further comprising the use of a fixturing device to compressibly force the shroud upon the impeller.

7. The method of claim 5, wherein the shroud is chamfered at its inner diameter before the shroud is attached to further ease the forcing of the shroud upon the impeller blades.

8. The method of claim 1, wherein said step of attaching the shroud element comprises:

heating the shroud element to increase the inner diameter of the shroud;

placing the heated shroud element in a juxtaposed relation to the impeller blades; and cooling the shroud element to create an interference fit to combine the shroud element and the impeller element.

9. The method of claim 2, wherein the selection of the shroud element comprises the use of finite element analysis software to perform the strength analysis.

10. A method of manufacturing a regenerative flow machine having a shroud attached to an impeller, comprising:

selecting a rotatable impeller element having impeller blades with radially extending distal ends defining a predetermined outer impeller diameter;

selecting a shroud element having an inner diameter less than the outer impeller diameter; and attaching the shroud element to at least some of the radially extending distal ends of the impeller blades by an interference fit between the inner shroud diameter and the outer impeller diameter.

11. A method of manufacturing a gas turbine engine having a shroud attached to an impeller, comprising:

selecting a rotatable impeller element having impeller blades with radially extending distal ends defining a predetermined outer impeller diameter;

selecting a shroud element having an inner diameter less than the outer impeller diameter; and attaching the shroud element to at least some of the radially extending distal ends of the impeller blades by an interference fit between the inner shroud diameter and the outer impeller diameter.

12. An improved impeller comprising:

a rotatable element having impeller blades with respective radially extending distal ends defining an outer impeller diameter; and a shroud surrounding the rotatable element and connected thereto by an interference fit with at least some of the distal ends.

13. A rotary machine including a helical flow compressor/turbine comprising:

a housing;

first and second stators positioned within the housing and having respective channels cooperating to define a substantially annular pathway within the housing;

a shaft rotatably supported within the housing;

a rotatable impeller element mounted for rotation with the shaft and having impeller blades substantially within the pathway, the impeller blades having respective radially extending distal ends defining an outer impeller diameter;

a shroud surrounding the rotatable impeller element and connected thereto by an interference fit with at least some of the distal ends, the shroud in transverse cross-section having a flat portion at the interference fit and a rounded portion outwardly thereof, whereby the rounded portion cooperates with the channels of the first and second stators to define a flow pathway around the shroud.

* * * * *